United States Patent [19]

Svensson

[11] 4,358,145

[45] Nov. 9, 1982

[54] LIFTING DEVICE FOR CONTAINER

[75] Inventor: Stig-Ake Svensson, Hammarö, Sweden

[73] Assignee: Scal Sweden AB, Lomma, Sweden

[21] Appl. No.: 147,913

[22] Filed: May 8, 1980

[30] Foreign Application Priority Data

May 9, 1979 [SE] Sweden ..... 7904086

[51] Int. Cl.[3] ..... B66C 1/66

[52] U.S. Cl. ..... 294/81 SF

[58] Field of Search ..... 294/67 R, 67 D, 67 DA, 294/81 SF, 83 R, 86 R, 110 R, 110 B

[56] References Cited

U.S. PATENT DOCUMENTS 2,776,857 1/1957 Heppenstall ..... 294/110 R X 3,868,139 2/1975 Drelicharz ..... 294/81 SF

FOREIGN PATENT DOCUMENTS 492867 9/1938 United Kingdom ..... 294/110 R 565005 8/1977 U.S.S.R. ..... 294/81 SF

*Primary Examiner*—Johnny D. Cherry

*Attorney, Agent, or Firm*—Silverman, Cass & Singer

[57] ABSTRACT

The lifting device comprises a frame to which coupling members are provided to co-operate with attachment members located in the corners of the container. Each coupling member is capable of cooperating with an attachment member so that at a first reciprocal movement of the coupling member, coupling between the coupling member and the attachment member takes place, and so that at a further reciprocal movement of the coupling member the coupling member and the attachment member are uncoupled. The reciprocal movement is caused by the bottom end of the coupling member striking the bottom interior surface of the attachment member.

1 Claim, 5 Drawing Figures

LIFTING DEVICE FOR CONTAINER

BACKGROUND OF THE INVENTION

This invention relates to a lifting device for containers or the like which usually are parallelepiped and in certain cases are designed according to international standards.

The use of such containers for transporting goods of many kinds has during the last few years increased to an especially high degree. The handling of containers at goods depots, ports, etc. has increased to a corresponding degree.

The handling of containers or other unit loads takes place in several ways, depending on several factors, for example the conditions at the port and the type of ship. Also the extent of the move is an influence.

When a fork lift truck is used, as is usual, the container is provided in connection to its bottom, with tunnels for the forks. Top lift or side lift frames also are used, and a locking of the lift frame to the container proper often is effected by means of hydraulics, which is an expensive solution, because it requires an external power source and can be less attractive from a safety point of view.

For transport, cranes of different types can be used, for example when movement from a quay to the hold of a ship is concerned. The coupling between the crane and container then is effected by ropes, wires or the like provided with hooks. Cranes of a gripper type are also used. All the different methods of crane lifting have in common that the coupling operation involves manual movements. The same, of course, also applies to the uncoupling between the crane and container. At many handling places, for obvious reasons, the manual work also is risky to some extent.

There is, thus, a great need for a well-operating lifting device, which permits automatic coupling and uncoupling between crane and container or between fork lift truck with lift frame and container. The present invention relates to a lifting device of the aforesaid kind. In the case of fork lift truck, the invention implies that coupling and uncoupling can take place without requiring an external power source, at the same time the lifting device is highly satisfactory from a safety point of view. In the case of a crane, substantially all of the manual movements of coupling and uncoupling are eliminated, which is desirable from a safety point of view, and further, reduces labor demand and thereby the handling costs.

A further advantage of the lifting device according to the present invention is that it can be used with a container design, which is not changed compared with that of to-day. This design must be regarded as a substantially absolute requirement, because the design of containers to-day is highly standardized. This applies especially to so-called ISO-containers, which are designed according to international standards, are used for international transport and are exchanged between different countries.

A lifting device for the purpose here concerned further must meet high requirements of operational safety and at the same time the need for maintenance shall be small. A lifting device according to the present invention can be expected to be very safe in operation and requires maintenance to a very limited extent.

The present invention, thus, relates to a lifting device for a container or the like.

SUMMARY OF THE INVENTION

The invention is characterized in that it comprises a frame, in connection with coupling means are provided to co-operate with attachment members located in the corners of the container. Each coupling means comprises a coupling member and is capable through the coupling member to co-operate with an attachment member in such a manner, that at a first reciprocatory movement of the coupling member the coupling means and the attachment member are coupled together and that at a further reciprocatory movement of the coupling member the coupling means and attachment member are uncoupled.

BRIEF DESCRIPTION OF THE DRAWINGS

The invention is described in greater detail in the following, with reference to to the accompanying drawings.

DESCRIPTION OF THE PREFERRED EMBODIMENT

Figure 1:
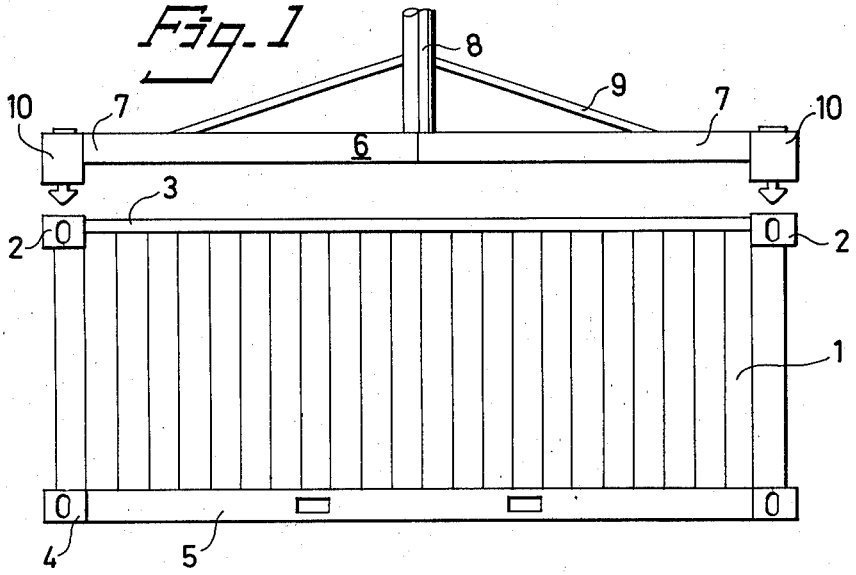
FIG. 1 shows an embodiment of a lifting device according to the present invention and a container, seen in the side elevation along one long side of the container.

In FIG. 1 the numeral 1 designates a schematically shown container of ISO-type having dimensions of $20' \times 8' \times 8'6''$, seen in side elevation along one of its long sides, to which container an embodiment of the invention is applied by way of example. The container 1 is provided in its corners with attachment members 2 connected to its upper side 3 and with attachment members 4 connected to its lower side 5. In the application of the present invention, the attachments 2 connected to the upper side 3 of the container are utilized.

According to one embodiment of the present invention, the lifting device comprises a frame 6 consisting of four arms 7 arranged in one plane, a lift rod 8 attached in a suitable way to the arms and intended to be connected in a suitable way to a crane or the like, and supporting struts 9 between the arms 7 and lift rod 8. At the free end of each of the arms 7, coupling means 10 are provided.

Figure 2:
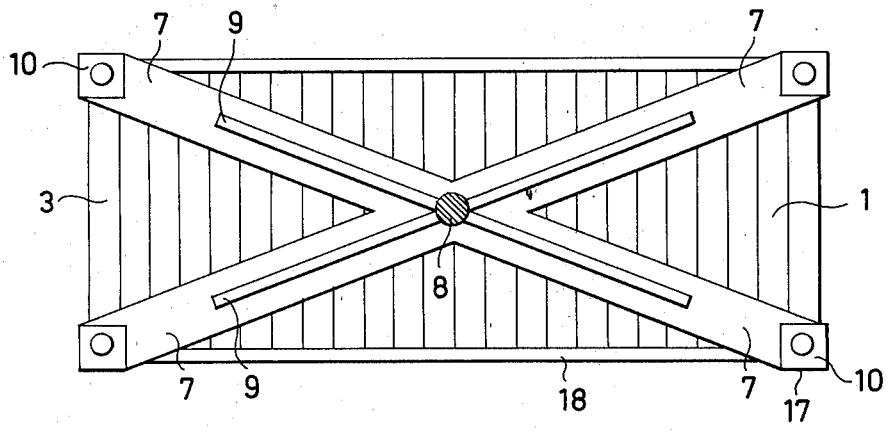
FIG. 2 shows the lifting device and the container according to FIG. 1, seen from above in FIG. 1.

The arms 7 are arranged so that the relative distances between the coupling means 10 are equal to the relative distances between the attachment members 2, in order to render it possible to couple together said coupling means 10 and the attachment members 2 when the lifting device is positioned in relation to the container 1 in the way intended, as shown in FIGS. 1 and 2, i.e. so that a coupling means 10 connects to each attachment member 2.

In the case of a fork lift truck, the frame 6 corresponds to a lift frame of a top lift or side lift type. Lift frames of this kind, for example, may consist of a rectangular frame with four corners or of a beam with two ends. The frame and, respectively, beam may be either fixed or designed so that its extension can be varied, for example hydraulically. Coupling means 10 in this case preferably are arranged in connection to the frame corners or beam ends.

Figure 3:
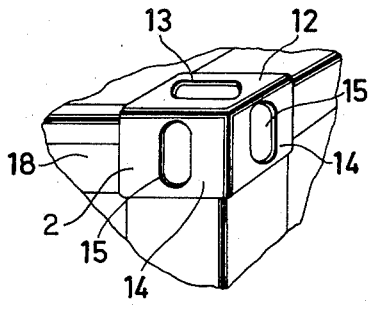
FIG. 3 is a schematic view of an attachment member associated with a container.

In FIG. 3 the attachment member 2 is shown. The attachment member 2 is of standard type and on its exterior upper side wall 12 is provided with a continuous oblong hole 13, the longitudinal direction of which is in parallel with the longitudinal direction of the container. The attachment member 2 is in principle a parallelepipedic shell. The attachment member further is provided on its two exterior free side walls 14 with oblong holes 15 corresponding to the hole 13 and continuous in a vertical direction.

Figure 4:
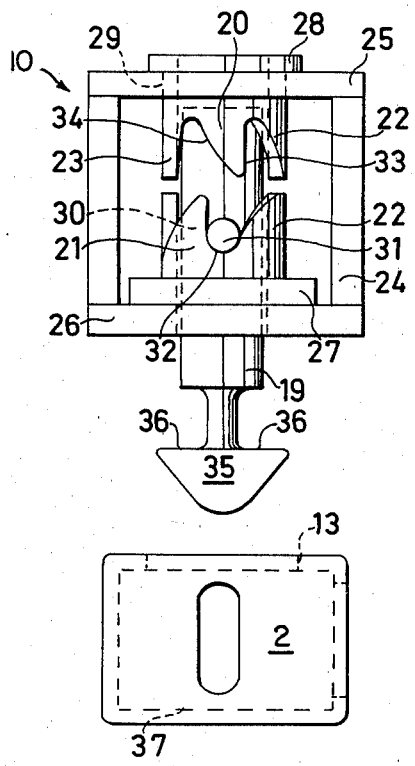
FIG. 4 shows a coupling means according to the present invention, where one sidewall has been removed, and is a lateral view of an attachment member according to FIG. 3 where the coupling means is in position for being coupled to the attachment member.

FIG. 4 is a lateral view of the coupling means 10 where a sidewall 17 of the coupling means has been removed, and the attachment member 2 is seen in the direction along the long side 18 of the container 1.

The coupling means comprise a coupling member 19, which in the embodiment here preferred, consists of a substantially cylindric axle 19, which is rotatably and axially movably mounted in an upper tubular sleeve 20 and a lower tubular sleeve 21, as shown in FIG. 4.

Each sleeve 20,21 is toothed at one end 22 and has four teeth 23 equally spaced along the circumference of the sleeve.

The sleeves 20,21 are arranged in a parallelepipedic holder with sidewalls 24, an upper side 25 and a bottom 26. The sleeves 20,21 are provided with flanges 27,28 with the flange 27 of the lower sleeve 21 abutting and in a suitable way being attached to the bottom 26, and with the flange of the sleeve 20 abutting and in a suitable way being attached to the upper side 25 via a hole 29 in the upper side 25, as appears from FIG. 4.

The sleeves 20,21 are aligned with their longitudinal axes aligned with one another in such a manner, that said toothed ends are located a suitable distance from and facing toward each other, and so that the teeth of one sleeve are offset about 45° in a peripheral or circumferential direction from the teeth of the other sleeve 20,21.

The axle 19, on the portion 30 intended to be located in the holder 24,25,26, is provided with preferably two substantially cylindrical pivots 31, which are directed radially and project from the shell surface of the axle 19. Said pivots 31 are capable of a rest position shown in FIG. 4 and in a lift position shown in FIG. 5 to rest on the tooth bottom 32 between two adjacent teeth 23. The pivots 31 further are capable during a reciprocatory movement or displacement of said axle 19 in its axial direction to co-operate with said teeth, where the teeth have one side 33 in parallel with the axial direction of the axle 19 and one side 34 forming an angle of about 30° with said axial direction, so that the axle 19 is caused to rotate through substantially 90°. The axle 19, thus, rotates through 90° in a definite and always the same direction for each reciprocatory cycle of the axle 19, as is apparent from FIG. 4.

Figure 5:
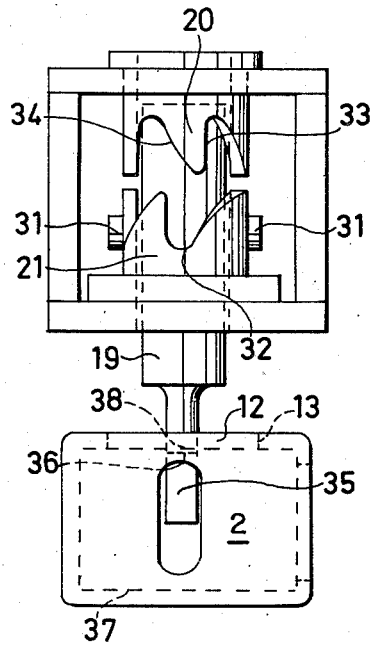
FIG. 5 shows the coupling means and the attachment member according to FIG. 4, with the difference that the coupled-together position is shown.

The axle 19, at its end 35 which is located outside the holder 24,25,26 and which co-operates with an attachment 2, is provided with flanges 36 of flat design, for example of an arrow point shape, as shown in FIGS. 4 and 5. Said end 35 is dimensioned of being capable to be introduced into the hole 13 in the attachment member 2 so that the flanges 36 by their extension relative to the width of the hole 13 prevent said end 35 from being removed out of the attachment member 2 when the axle 19 has been inserted into the hole 13 and has been rotated through about 90°.

The lifting device according to the invention operates as follows. The lifting device which is to be coupled together with a container, is brought near to the container 1 and positioned in relation thereto as shown in FIGS. 1 and 2. The axle ends 35 then have a position relative to the longitudinal direction of the holes 13 as shown in FIGS. 1 and 4. The lifting device is lowered so that the axle ends 35 are introduced into the holes 13 and so, that the ends 35 are pressed against the interior bottom wall 37 of the attachment members 2. The axles 19 thereby are moved in the sleeves 20,21, and the pivots 31 co-operate with the teeth 23 so that the axles 19 are caused to rotate through about 90°. Thus, the flanges 36 simultaneously are rotated in relation to the longitudinal direction of the holes 13, so that the axle ends no longer may be moved out of the holes 13.

When the lifting device is lifted by a crane, the flanges 36, thus, abut the inside 38 of the upper side 12 of the attachment members 2, as shown in FIG. 5.

When the container 1 has been positioned in the desired place, the lifting device is lowered so that the ends 35 again are pressed against the interior bottom wall 37 of the attachment members 2. The axles 19 thereby are moved again and caused to rotate through about 90°, whereafter the axle ends 35 can be removed from the holes 13.

As has been apparent from above, a lifting device according to the present invention renders it possible that coupling and uncoupling between lifting device and container can take place fully automatically, i.e. without manual operation. The construction, furthermore, is very simple, reliable in operation and can be simply adapted to standardized attachment design of containers.

It is obvious that a great number of embodiments of a lifting device according to the present invention can be imagined within the scope of the invention idea.

The axle 19, thus, in an obvious way can be spring-loaded whereby the operation reliability is increased and which also renders operation possible when the longitudinal direction of the axle 19 and the coupling means 10 are substantially horizontal and not vertical as in the embodiment described above. By spring-loading the axle 19 and by suitably designing the coupling means 10 in general as well as the frame 6, thus, the lifting device according to the invention can be coupled to containers also from directions other than from above, for example from the side. It is thus obvious that the invention also can be applied for lifting by fork lift trucks having a lift frame of the top lift and side lift type, in which connection the coupling means 10 preferably are arranged in connection to the corners or ends of the frames.

The frame 6, further, can be designed in several different ways, for example as a rectangular frame or as a substantially straight beam with only two ends having coupling means 10, where coupling takes place to only two, preferably diagonal ones of the attachment members 2 of the container 1.

The described lift rod 8 can be designed in several ways, for example with a means for gravity centering for lifting by a crane. For lifting by a lift fork truck the lift rod preferably is replaced by a recess in the lift frame.

The number of pivots 31 on the axles 19 can be varied from one to four pivots with the embodiment of the sleeves 20,21 described above.

The holder 24,25,26 for the sleeves 20,21 also can be designed so that the sleeves and the portion of the axle 19 co-operating with the sleeves are commpletely encased.

The axle ends 35, further, can be designed in a different way, for example more "robustly", in order to obtain an optimum design from a strength point of view.

The invention, thus, must not be regarded restricted to the embodiment described above, but can be varied within the scope of the attached claims.

I claim:

1. A lifting system for lifting parallelepiped containers, comprising:

attachment means secured to the container at the corners of the container, each attachment means defining a shell including at least an exterior side wall and an opposed interior side wall, the exterior side wall including an oblong hole therethrough;

a frame;

coupling means attached to the frame for co-operating with each attachment means to couple the frame to the container and to uncouple the frame from the container, the coupling means including upper and lower tubular sleeve spaced from one another and fixed on the frame with their longitudinal axes aligned with one another, the sleeves include teeth uniformly spaced around their circumferences and facing one another, the teeth of one sleeve being offset about 45° in a circumferential direction to the teeth of the other sleeve, the coupling means including a coupling member which is cylindrical and which is mounted in the sleeves to be rotatably and axially movable therein, the coupling member includes two radially projecting pivots arranged between the teeth of the sleeves, the pivots and teeth co-operating so that for every up and down reciprocal cycle of the coupling member in an axial direction, the coupling member is rotated about 90°, the coupling member further being provided with an arrow point shaped lower end having upper oblong flanges dimensioned to pass through the oblong hole of the attachment means in one rotational position of the coupling member and capable of being retained in the attachment means when the coupling member is rotated about 90° from the one rotational position, the arrow point shaped lower end having a downwardly directed substantially pointed tip, the lower end of the coupling member extending a sufficient distance to pass through the oblong hole and engage the substantially pointed tip against the opposed interior wall in substantially point contact to cause reciprocal movement of the coupling member within the sleeves and rotational movement about the point contact between the tip and the interior wall as the frame is moved in a reciprocating manner adjacent the container;

so that as the frame is moved towards the container, the lower ends of all of the coupling members pass through the oblong holes of the attachment means and the substantially pointed tips engage against the opposed interior walls of the attachment means to cause the coupling members to rotate 90° about the tips for every cycle due to the co-operation between the pivots and toothed sleeves, the frame then is moved away from the container and the flanges of the coupling members are retained in the attachment means to couple the frame and container together, the frame then is moved towards the container to engage the substantially pointed tips of the lower ends of the coupling members against the opposed interior walls to cause the coupling members to rotate about 90° and the frame is moved away from the container to remove the coupling members through the oblong holes to uncouple the frame and container from one another so that a great force may be applied to the frame to couple and uncouple the container.

* * * * *